US007653207B2

(12) United States Patent
Bebenroth et al.

(10) Patent No.: US 7,653,207 B2
(45) Date of Patent: Jan. 26, 2010

(54) BISTABLE SPREADING HEAD HARNESS

(75) Inventors: Wolf-Dietrich Bebenroth, Celle (DE); Jan Peter Kuhtz, Celle (DE)

(73) Assignee: Sennheiser Electronic GmbH & Co, Wedemark (DE)

( * ) Notice: Subject to any disclaimer, the term of this patent is extended or adjusted under 35 U.S.C. 154(b) by 85 days.

(21) Appl. No.: 11/631,920

(22) PCT Filed: Jul. 7, 2005

(86) PCT No.: PCT/EP2005/007327

§ 371 (c)(1),
(2), (4) Date: May 30, 2007

(87) PCT Pub. No.: WO2006/005501

PCT Pub. Date: Jan. 19, 2006

(65) Prior Publication Data

US 2007/0289130 A1 Dec. 20, 2007

(30) Foreign Application Priority Data

Jul. 8, 2004 (DE) ..... 10 2004 033 232

(51) Int. Cl.
*H04R 25/00* (2006.01)

(52) U.S. Cl. ..... 381/378

(58) Field of Classification Search ..... 381/374, 381/370, 377, 378, 379; 379/430
See application file for complete search history.

(56) References Cited

U.S. PATENT DOCUMENTS

| | | | | |
|---|---|---|---|---|
| 1,487,351 | A * | 3/1924 | Montan | 381/374 |
| 2,075,196 | A | 3/1937 | Hand | |
| 2,149,341 | A * | 3/1939 | Harrison | 381/379 |
| 2,237,752 | A | 4/1941 | Clarke | |
| 3,053,944 | A | 7/1962 | Weeks et al. | |
| 4,634,816 | A | 1/1987 | O'Malley et al. | |
| 5,369,857 | A * | 12/1994 | Sacherman et al. | 29/594 |
| 6,611,963 | B2 * | 9/2003 | Woo et al. | 2/209 |
| 2003/0169898 | A1 * | 9/2003 | Arasawa | 381/383 |

FOREIGN PATENT DOCUMENTS

| | | |
|---|---|---|
| DE | 78 08 135 | 7/1978 |
| DE | 79 14 767 | 8/1979 |
| DE | 31 30 059 | 4/1982 |
| GB | 1177925 | 1/1970 |

* cited by examiner

*Primary Examiner*—Neil Abrams
(74) *Attorney, Agent, or Firm*—Reed Smith LLP

(57) ABSTRACT

The invention is directed to a spreading head harness for headphones or headsets and to headphones or headsets having a spreading head harness of this kind. In order to provide a spreading head harness for headphones or headsets which automatically spreads when opening or widening and remains spread during use and in which the partial harnesses are automatically brought together again after use, it is suggested to use partial harnesses and/or connection members of which the end areas twist around the longitudinal axis relative to the spring regions, the end areas are bent relative to the curvature, and a mechanical tension is generated in the partial harness when mounted.

10 Claims, 3 Drawing Sheets

BISTABLE SPREADING HEAD HARNESS

CROSS-REFERENCE TO RELATED APPLICATIONS

This application claims priority of International Application No. PCT/EP2005/007327, filed Jul. 7, 2005 and German Application No. 10 2004 033 232.0, filed Jul. 8, 2004, the complete disclosures of which are hereby incorporated by reference.

BACKGROUND OF THE INVENTION a) Field of the Invention

The present invention is directed to a partial harness for a spreading head harness for headphones or headsets, a connection member for a spreading head harness, and headphones or headsets with spreading head harnesses of this kind.

b) Description of the Related Art

Spreading head harnesses are used to ensure a comfortable, secure fit of headphones or headsets on the head particularly for professional applications. The pressing pressure of the harness, that is, the pressure with which the head harness presses the headphone ear pieces against the head, should not be too great. The spreading of the head harness consists in that at least two partial harnesses are spread apart and accordingly rest on the head in different locations.

Known spreading head harnesses are spread manually before or after being placed on the head. In order to wear on the head, the head harness is opened or widened, i.e., the headphone ear pieces are drawn apart until the headphones or the headset can be placed on the head. Also, when worm, that is, during use, the head harness is still open in the sense that the headphone ear pieces are farther apart from one another than in the relaxed state of the head harness. The resulting tension presses the headphone ear pieces against the ears.

As a result of this tension, known spreading head harnesses tend to draw together or even to close entirely in spite of the friction in their connection members. This is considered disadvantageous particularly because, aside from the diminished wearing comfort, it is possible for hair to be caught and painfully torn out when removing the head harness. Another disadvantage is the need to manually spread apart the partial harnesses and also to manually bring them together again after use.

OBJECT AND SUMMARY OF THE INVENTION

It is the primary object of the invention to provide a spreading head harness for headphones or headsets which automatically spreads when opening or widening and remains spread during use and in which the partial harnesses are automatically brought together again after use.

This object is met by a partial harness for a spreading head harness for headphones or a headset with at least two partial harnesses for receiving at least one headphone ear piece at an end area with a substantially arc-shaped curvature, wherein the partial harness has a flexible spring region for elastic widening and contraction of the partial harness in which the end areas twist around the longitudinal axis relative to the spring region, are bent relative to the curvature, and can be mounted at connection members for generating a mechanical tension in the partial harness.

The above-stated object is met in a corresponding manner by a connection member for a spreading head harness for headphones or a headset with at least two partial harnesses with a substantially arc-shaped curvature, wherein each partial harness has a flexible spring region for elastic widening and contraction of the partial harness and two end areas and two connection members, wherein the connection member has holding members at which the end areas of the partial harnesses can be mounted, in which the holding members are designed for twisting of the end areas around the longitudinal axis relative to the spring regions, bending of the end areas relative to the curvature, and for generating a mechanical tension in the partial harness in mounted state.

The invention is based on the insight that an automatic spreading and closing of the partial harnesses can be brought about by introducing mechanical tensions in the spreading head harness in addition to the tension caused by the opening and wearing of the headphones. The corresponding tensions can be generated by torsion in conjunction with bending.

There are two basic possibilities for introducing these tensions in the partial harnesses. First, the partial harness itself can be designed in accordance with one aspect of the invention, wherein the object according to the invention can already be met by assembling with conventional connection members. Second, conventional partial harnesses, i.e., without torsion or bending, can be provided with mechanical tensions when assembling with connection members in accordance with another aspect of the invention in such a way that the above-stated object is met.

In a preferred construction of the invention, the flexible spring region is fashioned in its entirety from one material, particularly spring steel. As regards the mechanical tensions occurring in the partial harness, weak points may occur at the connection points in a multipart construction and may break in the course of use. The use of spring steel is recommended because an advantageous manufacture can be combined with good manageability and highly consistent quality.

In an advantageous construction of the invention, the end areas are twisted in opposite directions relative to the spring region. The torsional tensions introduced at the end areas by this twisting supplement one another when mounting.

It has proven advantageous to twist the end areas relative to the spring region by an angle between 0° and 45°, preferably between 10° and 20°, particularly about 15°.

In another construction of the invention, the end areas are bent inward relative to the curvature to introduce a corresponding tension when mounting.

Further, it has proven advantageous that the end areas are bent relative to the curvature by an angle between 0° and 20°, preferably between 0° and 10°, particularly about 5°.

In a preferred construction of the invention, the partial harness is constructed in such a way that a cable is guided from one end area to the other end area through the partial harness. Guiding a cable through a partial harness has the advantage that a signal feed to the electroacoustic transducer of the headphones need take place on only one side of the headphones. Accordingly, a user will not be hindered by cables running from both sides of the headphones.

In an advantageous construction of the invention, the partial harness has a sheathing for guiding a cable from one end area to the other end area through the sheathing. This makes it possible to guide the cable in a corresponding manner without altering the spring region of the partial harness itself.

According to the invention, headphones or a headset with a spreading head harness and at least one headphone ear piece has partial harnesses and/or connection members according to one of claims 1 to 9, wherein at least one holder is arranged at the end areas of the partial harnesses and/or connection members for the at least one headphone ear piece.

The invention will be described more fully in the following with reference to advantageous embodiment forms shown in the accompanying drawings.

DESCRIPTION OF THE PREFERRED EMBODIMENTS

Figure 1:
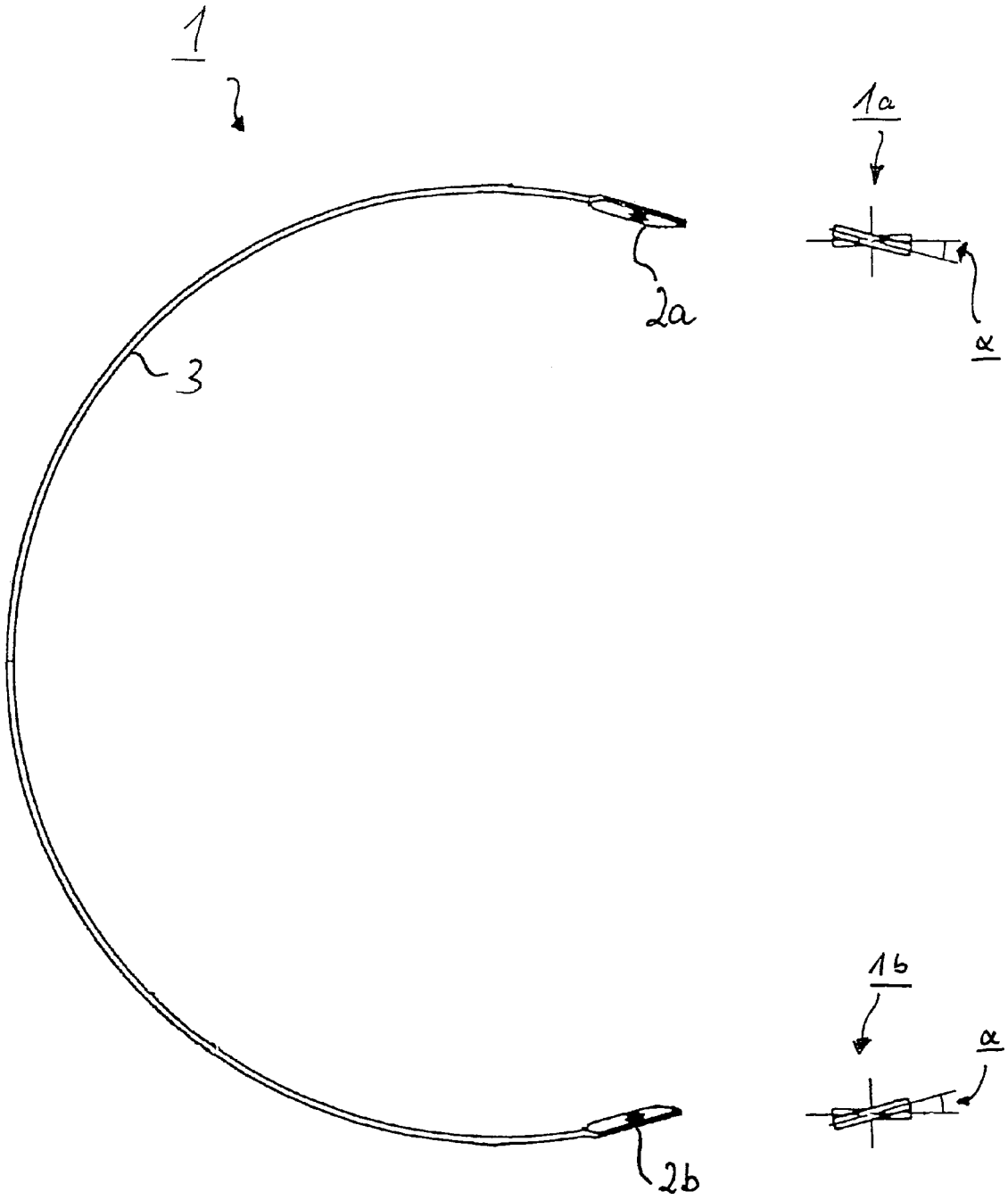
FIG. 1 is a front view of a partial harness according to the invention with detailed views of the end areas along their longitudinal axis.

FIG. 1 shows a front view of a partial harness 1 according to the invention which is uniformly curved in an arc-shaped manner in the present embodiment form so that it substantially has the shape of a circular section along the angular range of somewhat greater than 180°. As can be seen from the detailed views 1*a* and 1*b*, the cross section of the partial harness 1 substantially corresponds to a flat rectangle, and the wide sides of the cross section correspond to the inner side and outer side of the curvature. The detailed views 1*a* and 1*b* illustrate the twisting of the end areas 2*a* and 2*b* along their longitudinal axis by an angle $\alpha$ relative to the spring region 3 which, in this embodiment form, extends along the entire partial harness 1 with the exception of the end areas 2*a*, 2*b*. In the present embodiment form, the angle $\alpha$ is approximately equal to 15°.

Figure 2:
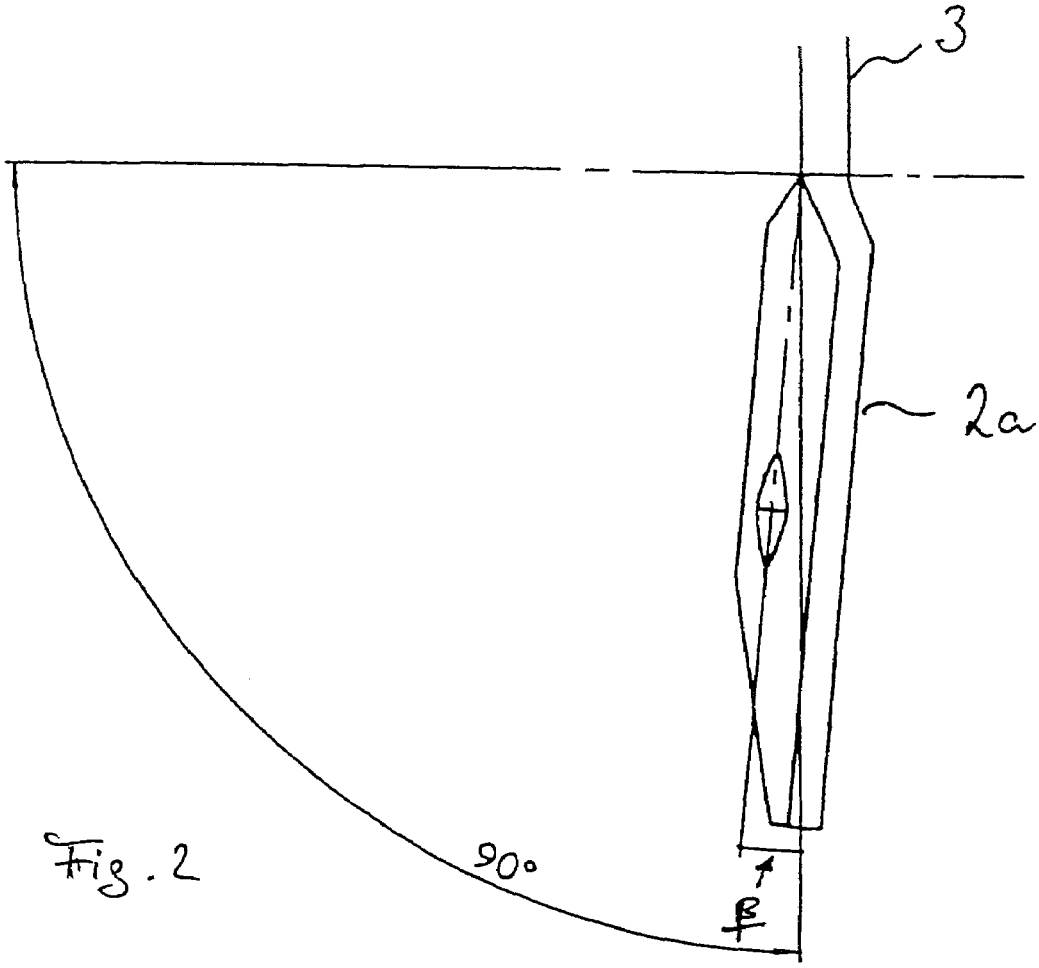
FIG. 2 shows a front view of an end area of a partial harness according to the invention in an enlarged view compared to FIG. 1.

FIG. 2 shows a front view of an end area 2*a* of a partial harness 1 according to the invention which is enlarged compared to FIG. 1. The end area 2*a* is bent, in this case inward, at an angle $\beta$ relative to a tangent at the transition between the curved spring region 3 and end area 2*a*. In the present embodiment form, the angle $\beta$ is approximately 5°.

Figure 3:
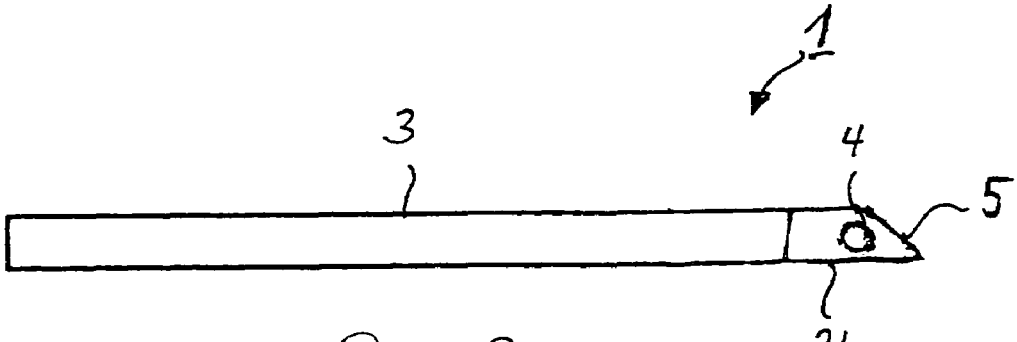
FIG. 3 shows a side view of the partial harness according to the invention shown in FIG. 1.

FIG. 3 shows a side view of the partial harness 1 according to the invention shown in FIG. 1. The end areas 2*a*, 2*b* each have one hole 4 which enables a simple connection between the partial harness 1 and the connection member (not shown here), e.g., by means of a screw. The bevel 5 at the end of the end area 2*a*, 2*b* located opposite from the spring region 3 in conjunction with an appropriate construction of the connection member makes it possible to limit the spreading of the spreading head harness to a maximum value.

Figure 4:
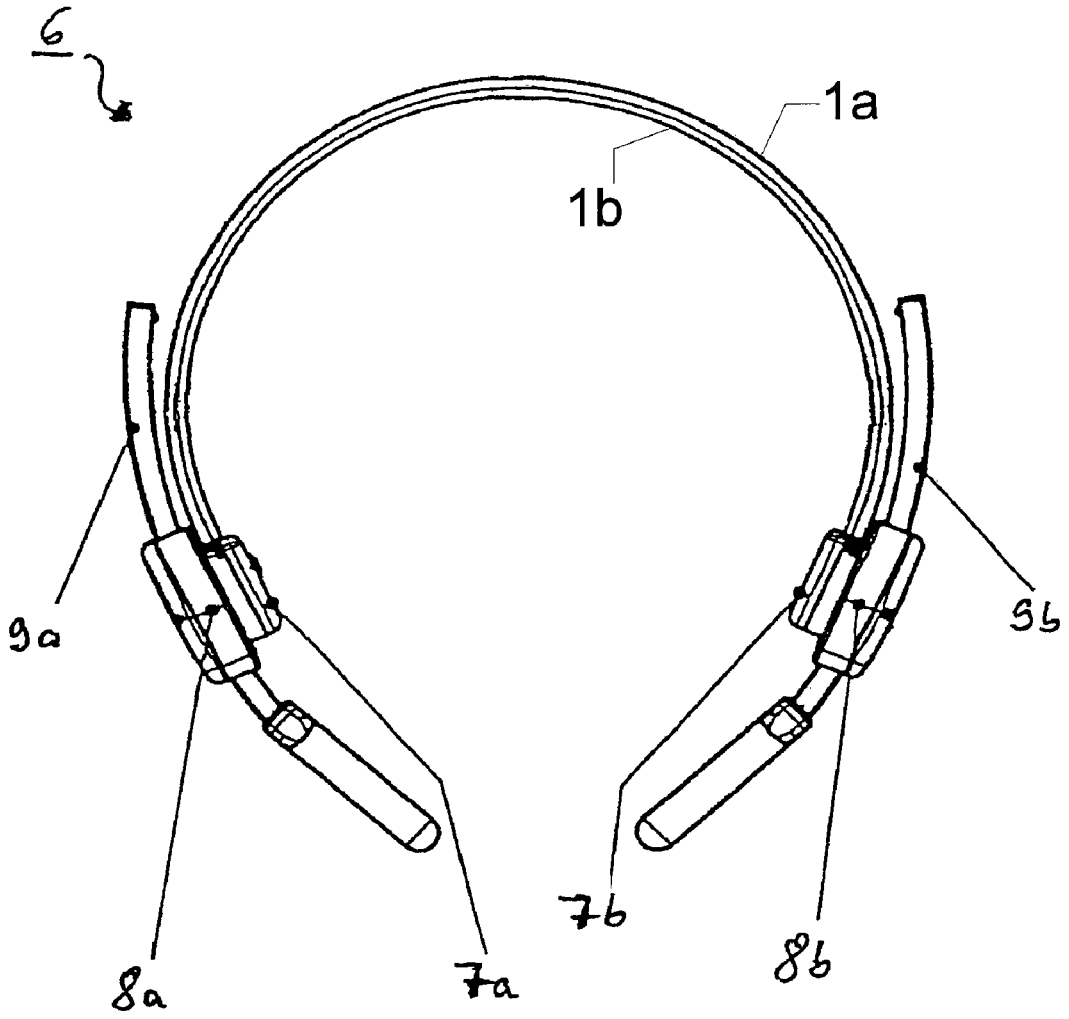
FIG. 4 is a front view of headphones according to the invention.

FIG. 4 shows a front view of headphones 6 according to the invention. The headphones 6 have two partial harnesses, first harness member 1*a* and second harness member 1*b*, whose end areas 2*a*, 2*b* (not shown) are mounted at or in connection members 7*a*, 7*b* which in turn have holders 8*a*, 8*b* for receiving carrying members 9*a*, 9*b* for headphone ear pieces (not shown). The first and second harness members 1*a*,1*b* are spread when the headphones 6 are being used. This spreading is carried out in such a way that the first and second harness members 1*a*, 1*b* are tilted forward or backward out of the drawing plane. The headphones 6 can also be designed in such a way that they have only one headphone ear piece. However, an additional device may be provided at the end areas 2*a*, 2*b* or at the connection member 7*a*, 7*b* at which no headphone ear piece is arranged and is pressed against the head corresponding to a headphone ear piece.

By headphones and headset is meant not only devices having electroacoustic transducers but in a broader sense, also devices serving, for example, to dampen sound or as sound insulation for the ear.

Figure 5:
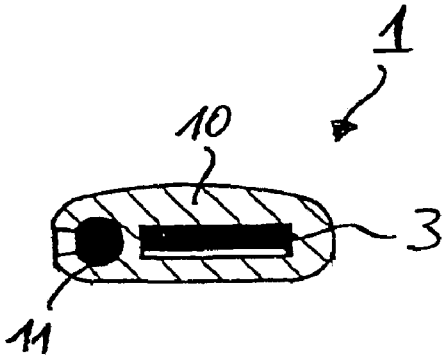
FIG. 5 shows a cross section through a partial harness, according to the invention, of the headphones shown in FIG. 4.

FIG. 5 shows a cross section through a partial harness 1, according to the invention, of the headphones 6 shown in FIG. 4. The partial harness 1 has a sheathing 10 which extends around the spring region 3 and which has a guide-through 11 through which a cable can be guided from one end area 2*a*, 2*b* of the partial harness 1 to the other.

A spreading head harness with partial harnesses according to the invention and/or connection members according to the invention is user-friendly because it spreads automatically when widening for placing on the head and cancels the spreading automatically after use, that is, in the contracted state. There is no risk that the user's hair will be caught because the spreading is also maintained during use.

While the foregoing description and drawings represent the present invention, it will be obvious to those skilled in the art that various changes may be made therein without departing from the true spirit and scope of the present invention.

The invention claimed is:

1. A spreading head harness for headphones or a head set, comprising a first and a second harness member each with a substantially arc-shaped curvature and a first and a second connection member for receiving headphone ear pieces, each harness member comprising:

a first and a second end area;

a flexible spring region for elastic widening and contraction of the harness member having a longitudinal axis;

said first and second end areas being twisted relative to the spring region around the longitudinal axis of the spring region and bent relative to the arc-shaped curvature for generating a mechanical tension in the harness member;

wherein the first end areas of the first and second harness member are connected to the first connection member;

wherein the second end areas of the first and second harness member are connected to the second connection member;

wherein in a first operating position the first and second harness member extend substantially parallel to each other;

wherein in a second operating position, when the connection members are pulled away from each other and the flexible spring region of the first and second harness member are widened, the first and second harness member are spread from each other due to a mechanical tension in the end areas of the first and second harness member.

2. The harness according to claim 1, wherein the flexible spring region is fashioned in its entirety from spring steel.

3. The harness according to claim 1, wherein the end areas are twisted in opposite directions relative to the spring region.

4. The harness according to claim 1, wherein the end areas are twisted relative to the spring region by an angle ($\alpha$) greater than 0° and less than 45°.

5. The harness according to claim 1, wherein the end areas are bent inward relative to the curvature.

6. The harness according to claim 1, wherein the end areas are bent relative to the curvature by an angle ($\beta$) greater than 0° and less than 20°.

7. The harness according to claim 1, wherein the partial harness is constructed in such a way that a cable is guided from one end area to the other end area through the partial harness.

8. The harness according to claim 1, wherein the partial harness has a sheathing for guiding a cable from one end area to the other end area through the sheathing.

9. The harness according to claim 1, wherein the connection member comprises:

holding members at which the end areas of the harness member can be mounted;

said holding members being designed for twisting of the end areas around the longitudinal axis relative to the spring regions, bending of the end areas relative to the curvature, and for generation of a mechanical tension in the harness member when the end areas are mounted to the holding areas; and said end areas being twisted relative to the spring region when mounted to the holding members.

10. Headphones or a headset with a spreading head harness according to claim 1 and with at least one headphone ear piece, wherein at least one holder for the at least one headphone ear piece is arranged at the end areas of the harness member and/or connection members.

* * * * *